US010179682B2

(12) United States Patent
Brehm

(10) Patent No.: US 10,179,682 B2
(45) Date of Patent: Jan. 15, 2019

(54) PINBALL MACHINE COVER SYSTEMS AND METHODS

(71) Applicant: Darren Brehm, Chicago, IL (US)

(72) Inventor: Darren Brehm, Chicago, IL (US)

(73) Assignee: Pinball Armor, Inc., Kansas City, MO (US)

( * ) Notice: Subject to any disclaimer, the term of this patent is extended or adjusted under 35 U.S.C. 154(b) by 899 days.

(21) Appl. No.: 14/056,736

(22) Filed: Oct. 17, 2013

(65) Prior Publication Data

US 2014/0102606 A1 Apr. 17, 2014

Related U.S. Application Data

(60) Provisional application No. 61/715,120, filed on Oct. 17, 2012.

(51) Int. Cl.
*A47C 7/66* (2006.01)
*B65D 65/22* (2006.01)
*B65D 85/68* (2006.01)

(52) U.S. Cl.
CPC ..... *B65D 65/22* (2013.01); *B65D 85/68* (2013.01); *B65D 2313/02* (2013.01); *B65D 2585/6897* (2013.01)

(58) Field of Classification Search
CPC ..... B65D 81/3886; B65D 25/34; A61G 5/10; B62D 1/06; E04G 21/30
USPC ..... 150/154–166; D12/133, 401; 244/1 R; 297/219.12, 224, 229, 284.1
See application file for complete search history.

(56) References Cited

U.S. PATENT DOCUMENTS 2,228,948 A * 1/1941 Field ..... B60N 2/60 297/228.1
2,266,505 A * 12/1941 McCormick ..... B60N 2/60 297/228.1
4,598,883 A * 7/1986 Suter ..... B64F 1/005 150/166
4,647,043 A * 3/1987 Wiczer ..... A63F 7/027 16/231
4,693,289 A * 9/1987 Taylor ..... A61G 3/0209 150/166
4,811,767 A * 3/1989 Kessler ..... E04H 1/1238 150/154
5,340,055 A * 8/1994 Rodyniuk ..... B64F 1/005 150/166
5,611,501 A * 3/1997 Crandley ..... B64F 1/005 150/166

(Continued)

*Primary Examiner* — Fenn C Mathew
*Assistant Examiner* — Cynthia Collado
(74) *Attorney, Agent, or Firm* — Lund IP, PLLC

(57) ABSTRACT

This disclosure provides systems and methods for covering a pinball machine. Some systems may include a first shell configured to receive and cover an upper cabinet of a pinball machine. The first shell may include a first-shell fastening apparatus configured to secure the upper cabinet within the first shell. Some systems may include a second shell configured to receive and cover an upper cabinet and a lower cabinet of a pinball machine. The upper cabinet may be folded on top of the lower cabinet and secured to the lower cabinet using a cabinet fastening apparatus. The second shell may include a second-shell fastening apparatus configured to secure the upper and lower cabinet within the second shell.

32 Claims, 10 Drawing Sheets

(56) References Cited

U.S. PATENT DOCUMENTS

| | | | | | |
|---|---|---|---|---|---|
| 5,803,539 | A * | 9/1998 | Dewar | B60N 2/6054 | 297/228.1 |
| 5,845,873 | A * | 12/1998 | Millard | B65D 85/68 | 244/1 R |
| 2014/0326373 | A1 * | 11/2014 | D'Amato | A47C 7/66 | 150/158 |

* cited by examiner

PINBALL MACHINE COVER SYSTEMS AND METHODS

RELATED APPLICATIONS

This application claims priority to U.S. Provisional Patent Application No. 61/715,120 filed Oct. 17, 2012, the disclosure of which is herein incorporated by reference in its entirety.

TECHNICAL FIELD

This disclosure relates generally to pinball machines, and more particularly to an improved cover apparatus, system, and method for securely packaging pinball machines for storage, transportation, and shipping.

BACKGROUND

Pinball machines may be used for entertainment or collected for hobby or nostalgia. In recent years, pinball machines have grown in popularity, causing the pinball machines to appreciate in value. Accordingly, the costs associated with buying, restoring, and storing pinball machines are also increasing. A significant factor in determining the value of a pinball machine is the condition of the machine. As just one example, the condition of the cabinets, as well as any graphics or art displayed on the cabinet's surfaces, may be important in determining the value of the pinball machine. Thus, the value of a pinball machine may be directly correlated with how carefully a pinball machine is transported.

Transporting a pinball machine may include moving, shipping and/or storing the machine. Moving and shipping can include moving a pinball machine within a house or storage facility, as well as moving a machine from location to location. Safely transporting a pinball machine may be a significant factor in maintaining the condition of the cabinet as the cabinet is often subjected to damaging influences during transport.

Moving pinball machines is challenging because they are heavy, bulky, and awkward, while at the same time having delicate cabinets and finishes. Consequently, a typical approach is to try to protect the cabinet surfaces with cardboard, towels and/or blankets and the like. In order to keep these protective coverings in place, tape, shrink wrap or other outer wrapping material is used. This can be cumbersome and often ineffective. A mover generally wants protective coverings over the majority of the cabinet's surface area, but he/she typically tries to avoid tape or other adhesives from contacting the surface of the cabinet. The result is that it can be difficult to properly cover a machine in the first place, and the protective coverings can easily slip and move out of place, leaving an unprotected portion of the cabinet. While it may be possible to wrap a pinball machine comprehensively using such means, the process to do so can be quite time consuming and labor intensive. As a result, movers may seek to find short cuts, leading to a longer-than-desired packing process and inadequately protected machines, as well as inconsistencies from one packing process to another.

SUMMARY

In some embodiments, a cover apparatus for use with a pinball machine is provided. The cover apparatus can include a first shell configured to cover an upper cabinet of the pinball machine. The first shell can include a first-shell body having a first-shell opening configured to receive the upper cabinet. The first shell can include a first-shell fastening apparatus coupled to the first-shell body and configured to secure the upper cabinet within the first-shell body. The cover apparatus can include a cabinet fastening apparatus configured to secure the upper cabinet to a lower cabinet of the pinball machine. The cover apparatus can include a second shell configured to cover the lower cabinet. The second shell can include a second-shell body having a second-shell opening configured to receive the lower cabinet. The second shell can include a panel configured to substantially cover the second-shell opening. The second shell can include a second-shell fastening apparatus configured to secure the panel over the second-shell opening.

In some embodiments, a system is provided. The system can include a pinball machine. The pinball machine can include an upper cabinet and a lower cabinet. The system can include a first shell configured to cover the upper cabinet. The first shell can include a first-shell body having a first-shell opening configured to receive the upper cabinet. The first shell can include a first-shell fastening apparatus coupled to the first-shell body and configured to secure the upper cabinet within the first-shell body. The system can include a cabinet fastening apparatus configured to secure the upper cabinet to a lower cabinet of the pinball machine. The system can include a second shell configured to cover the lower cabinet. The second shell can include a second-shell body having a second-shell opening configured to receive the lower cabinet. The second shell can include a panel configured to substantially cover the second-shell opening. The second shell can include a second-shell fastening apparatus configured to secure the panel over the second-shell opening.

Some embodiments of the cover apparatus and the system may have one or more of the following features. In some embodiments, the second shell is configured to cover the first shell, the upper cabinet, and the lower cabinet. In some embodiments, the cabinet fastening apparatus is coupled to the first shell. In some embodiments, the cabinet fastening apparatus is integral with the first shell. In some embodiments, the first-shell fastening apparatus comprises one or more fastening mechanisms and one or more straps. In some embodiments, the one or more fastening mechanisms of the first-shell fastening apparatus are configured to secure the one or more straps of the first-shell fastening apparatus across the first-shell opening to secure the upper cabinet within the first-shell body. In some embodiments, the one or more fastening mechanisms are selected from a group consisting of buttons, snaps, clips, and hook-and-loop fasteners. In some embodiments, the cabinet fastening apparatus comprises one or more fastening mechanisms and one or more straps. In some embodiments, the one or more straps of the cabinet fastening apparatus are configured to wrap around both the upper cabinet and the lower cabinet and the one or more fastening mechanisms of the cabinet fastening apparatus are configured to fasten the one or more straps to secure the upper cabinet to the lower cabinet. In some embodiments, the second shell further includes a skirt disposed along at least one edge of the second-shell opening. In some embodiments, the second-shell fastening apparatus is configured to secure the panel to the skirt. In some embodiments, the panel of the second shell is integral with the second-shell body. In some embodiments, the second shell further includes one or more slits configured to receive one or more legs of the pinball machine. In some embodiments, the second shell further includes one or more pockets configured to store one or more legs of the pinball machine.

In some embodiments, a method for covering a pinball machine that has an upper cabinet and a lower cabinet is provided. Some embodiments involve providing a first shell. The first shell can include a first-shell body having a first-shell opening and a first-shell fastening apparatus coupled to the first-shell body. Some embodiments involve providing a second shell. The second shell can include a second-shell body having a second-shell opening, a panel, and a second-shell fastening apparatus. Some embodiments involve covering the upper cabinet with the first shell by inserting the upper cabinet into the first-shell body via the first-shell opening and securing the upper cabinet within the first-shell body with the first-shell fastening apparatus. Some embodiments involve securing the upper cabinet to the lower cabinet using a cabinet fastening apparatus. Some embodiments involve covering the lower cabinet with the second shell by inserting the lower cabinet into the second-shell body via the second-shell opening, substantially covering the second-shell opening with the panel, and securing the panel over the second-shell opening with the second-shell fastening apparatus.

Some embodiments of the method for covering a pinball machine may have one or more of the following features. In some embodiments, covering the lower cabinet with the second shell occurs after securing the upper cabinet to the lower cabinet. In some embodiments, covering the lower cabinet with the second shell includes covering the upper cabinet, the first shell, and the lower cabinet with the second shell. In some embodiments, the first-shell fastening apparatus includes one or more fastening mechanisms and one or more straps. In some embodiments, securing the upper cabinet within the first-shell body includes fastening the one or more straps of the first-shell fastening apparatus across the first-shell opening using the one or more fastening mechanisms. In some embodiments, the cabinet fastening apparatus includes one or more fastening mechanisms and one or more straps. In some embodiments, securing the upper cabinet to the lower cabinet includes wrapping the one or more straps of the cabinet fastening apparatus around both the upper cabinet and the lower cabinet and fastening the one or more straps using the one or more fastening mechanisms of the cabinet fastening apparatus. In some embodiments, the second shell further includes a skirt disposed along at least one edge of the second-shell opening. In some embodiments, securing the panel over the second-shell opening includes securing the panel to the skirt. In some embodiments, the second shell further includes one or more pockets. In some embodiments, the method further includes removing and storing one or more legs of the pinball machine in the second shell.

In some examples, a cover apparatus can be provided. The cover apparatus can be used with a pinball machine that has an upper cabinet hingedly connected to a lower cabinet. The cover apparatus can include a first shell. The first shell can be configured to cover the upper cabinet of the pinball machine. The first shell can include a shell body that has a shell opening. The first shell's opening can be configured to receive the upper cabinet. The cover apparatus can include a second shell. The second shell can be configured to cover the upper cabinet of the pinball machine and the first shell in a folded-down configuration, as well as the lower cabinet of the pinball machine. The second shell can include a shell body, which can have a shell opening. The second shell's opening can be configured to receive the upper cabinet, the first shell, and the lower cabinet. The second shell can include a shell fastening apparatus, which can be configured to secure the second shell relative to the received upper cabinet, the first shell, and the lower cabinet.

Some examples involve a method for covering a pinball machine that has an upper cabinet hingedly connected to a lower cabinet. The method can include providing a shell that includes a shell body having a shell opening and a shell fastening apparatus. The method can include folding the upper cabinet down into proximity with the lower cabinet. The method can include covering the upper cabinet and the lower cabinet with the shell. Such covering can include inserting the upper cabinet and the lower cabinet into the shell body via the shell opening. Such covering can include securing the shell relative to the upper cabinet and the lower cabinet.

Some such methods may include one or more of the following features or steps. The method may include providing a second shell that includes a shell body having a shell opening. Some such methods may include covering the upper cabinet with the second shell (e.g., by inserting the upper cabinet into the second shell's body via the shell opening) before folding the upper cabinet down into proximity with the lower cabinet. Some methods may include securing the upper cabinet within the second shell's body with a shell fastening apparatus after covering the upper cabinet with the second shell but before folding the upper cabinet down into proximity with the lower cabinet. Some methods may include securing the upper cabinet (with or without a second shell) to the lower cabinet using a cabinet fastening apparatus after folding the upper cabinet down into proximity with the lower cabinet but before covering the upper cabinet and the lower cabinet with the first shell. In some methods, the first shell substantially covers a top surface, side surfaces, and a front surface of the lower cabinet. In some methods, the first shell substantially covers a bottom surface and/or a rear surface of the lower cabinet.

Some other examples involve a method for covering a pinball machine that has an upper cabinet hingedly connected to a lower cabinet. The method can include providing a shell that includes a shell body having a shell opening. The method can include covering the upper cabinet with the shell by inserting the upper cabinet into the shell body via the shell opening. The method can include folding the upper cabinet down into proximity with the lower cabinet. The method can include securing the shell and the upper cabinet to the lower cabinet using a cabinet fastening apparatus.

Some such methods may include one or more of the following features or steps. Some methods include securing the upper cabinet within the shell body with a shell fastening apparatus after covering the upper cabinet with the shell but before folding the upper cabinet down into proximity with the lower cabinet. Some methods include providing a second shell. Some such methods involve covering the second the upper cabinet, the first shell, and the lower cabinet with the second shell. The upper cabinet, the first shell, and the lower cabinet can be inserted into the second shell's body via the shell opening. The second shell can then be secured relative to the upper cabinet, the first shell, and the lower cabinet.

Examples in this disclosure may provide one or more advantages over existing systems and methods to cover a pinball machine. For example, a pinball machine may be securely stored and/or moved, which provides the advantage of preserving the condition, and therefore the value, of the pinball machine. Some examples can protect the pinball machine from the elements (e.g., light, temperature, moisture, etc.), thereby preserving the condition of the pinball machine. Some examples are can cover a pinball machine where the upper cabinet has been folded onto the lower cabinet of the pinball machine. Such examples can provide the advantage of securely storing and/or moving the pinball machine in a space saving manner. Some examples provide for the removal and storage of legs of the pinball machine thereby further increasing the amount of space saved. In many examples, value preservation and space savings may be enjoyed by pinball machine owners and collectors.

BRIEF DESCRIPTION OF THE DRAWINGS

The following drawings are illustrative of particular embodiments of the invention and therefore do not limit the scope of the invention. The drawings are not necessarily to scale, unless so stated. Any dimensions indicated on the drawings are approximate, and may only be applicable for the embodiment depicted. The drawings are intended for use in conjunction with the explanations in the following detailed description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides some practical illustrations for implementing exemplary embodiments of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

Figure 1:
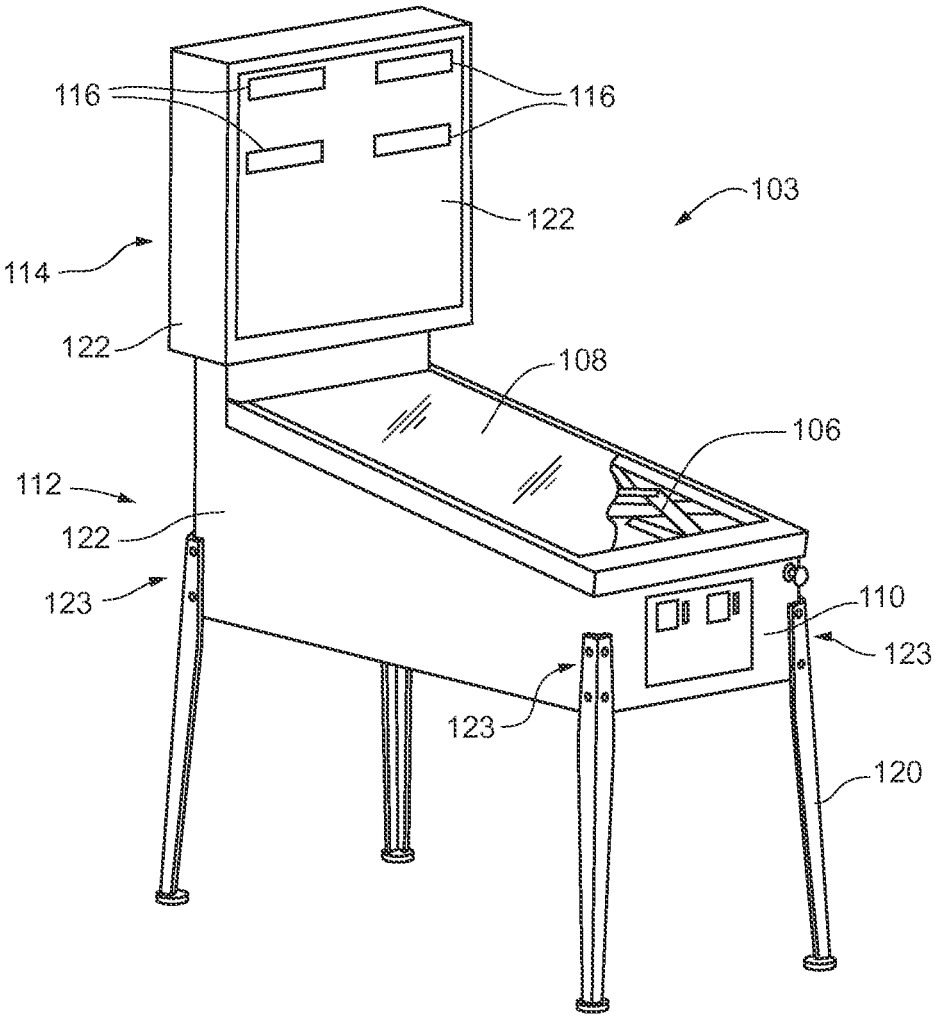
FIG. 1 is a front perspective view of a pinball machine.

FIG. 1 illustrates a pinball machine 103 which may include a playfield 106 and a glass sheet 108. The playfield 106 may be configured to support a moving ball, and the glass sheet 108 may be configured to substantially cover the playfield 106. In some examples, the playfield 106 may be angled downwardly toward a front 110 of the pinball machine 103, where a user can stand to play the pinball machine 103. The playfield 106 and the glass sheet 108 can be housed within a lower cabinet 112.

An upper cabinet 114 of the pinball machine 103 can be hingedly connected to the lower cabinet 112. The upper cabinet 114 can include one or more displays 116 which may be configured to display information regarding the progress of the game (e.g., score of the game). In some examples, the upper cabinet 114 can include a case 122 which may be formed from glass, plastic, or any other suitable material. In this example, the upper cabinet 114 may be supported by the lower cabinet 112, and both cabinets may be supported by one or more legs 120. The one or more legs 120 may be attached to the pinball machine via hardware 123 (e.g., screws, bolts, nails, etc.) to retain the legs in place. In certain examples, the pinball machine 103 may include four legs 120 configured to support the lower cabinet 112 so that the playfield 106 is approximately at waist height to a user. Both the upper cabinet 114 and lower cabinet 112 may include suitable graphics configured to facilitate game operation and/or to provide aesthetically pleasing illustrations, pictures, designs, or other artwork or drawings.

As discussed, a significant factor in the determining the value of a pinball machine is the condition of its cabinets. A large factor in the maintaining the condition of the cabinets of the pinball machine may include how the cabinets are stored or handled during transportation. Embodiments described and disclosed herein provide systems, methods and devices for easily and consistently covering a pinball machine for storage and transportation.

Figure 2:
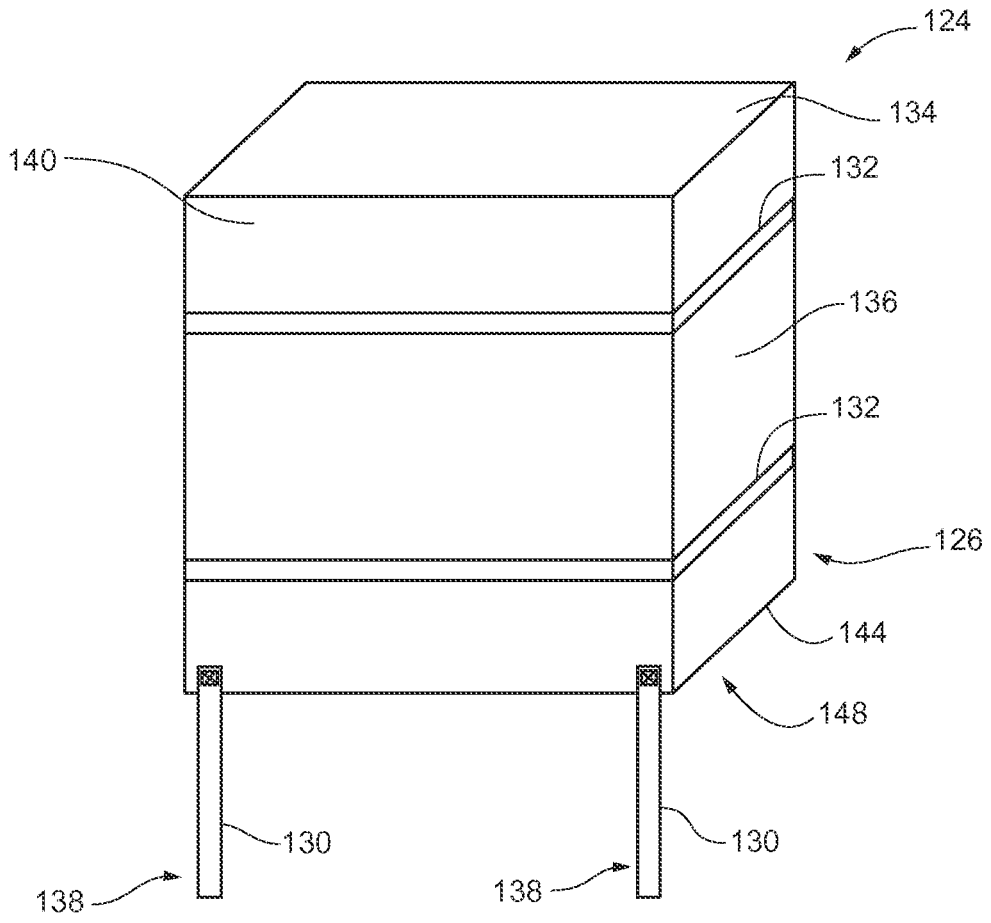
FIG. 2 is a front perspective view of a shell.

Reference is made to FIGS. 2-5. FIG. 2 depicts a shell 124 configured to cover and enclose an upper cabinet of a pinball machine. The shell 124 may include a shell body 126. In this example, shell body 126 may comprise a top panel 134, two side panels 136, a front panel 140 and a rear panel 142. The shell body 126 may comprise a shell opening 148 configured to receive an upper cabinet of a pinball machine. In some examples, the size of the shell body 126 may correspond with dimensions of an upper cabinet of a pinball machine such that shell body 126 will substantially cover and enclose the upper cabinet. In some examples, the shell body 126 may include any combination of panels and still be configured to receive the upper cabinet within the shell body 126. In some examples, the shell body 126 may include a bottom panel configured to cover an underside of the upper cabinet. As is discussed in greater detail elsewhere herein, the shell 124 can be made of padded material.

In some examples, shell 124 may include a shell fastening apparatus 145. The shell fastening apparatus 145 may be coupled to the shell body 126 and configured to secure an upper cabinet within the shell body 126. In certain examples, the shell fastening apparatus 145 may comprise one or more fastening mechanisms and one or more straps. In this example, the shell fastening apparatus 145 may comprise a set of straps 130 and a set of fastening mechanisms 146. As shown, the set of straps 130 and the set of fastening mechanisms 146 have two straps and two fastening mechanisms, but it should be appreciated that the set of straps 130 and the set of fastening mechanisms 146 can include any suitable number of straps and fastening mechanisms, such as one, three, four, and so on. The set of straps 130 may be attached to the front panel 140 near a lower edge 144 of the shell body 126, and the set of fastening mechanisms 146 may be attached on the lower edge 144 on an opposing side of the shell body 126. In some embodiments, the set of straps 130 may be attached to the rear panel 142 of the shell body 126 and may be attached on the lower edge 144 on an opposing side of the shell body 126. The set of fastening mechanisms 146 may be configured to secure the set of straps 130 across the shell opening 148 to substantially cover and enclose the upper cabinet within the shell body 126. In some examples, the set of fastening mechanisms 146 may comprise one or more hook-and-loop fasteners. One side of the hook-and-loop fasteners may be attached to a distal end 138 of the set of straps 130 and a corresponding side of the hook-and-loop fastener may be attached to the shell body 126 such that mating the corresponding sides of the hook-and-loop fasteners will cause the set of straps 130 to secure the upper cabinet within the shell body 126. One skilled in the art will appreciate that in other examples, shell fastening apparatus 145 may comprise any type of fastening mechanisms suitable for a particular application. As discussed elsewhere herein, in some examples, shell 124 may not include a shell fastening apparatus.

Figure 3:
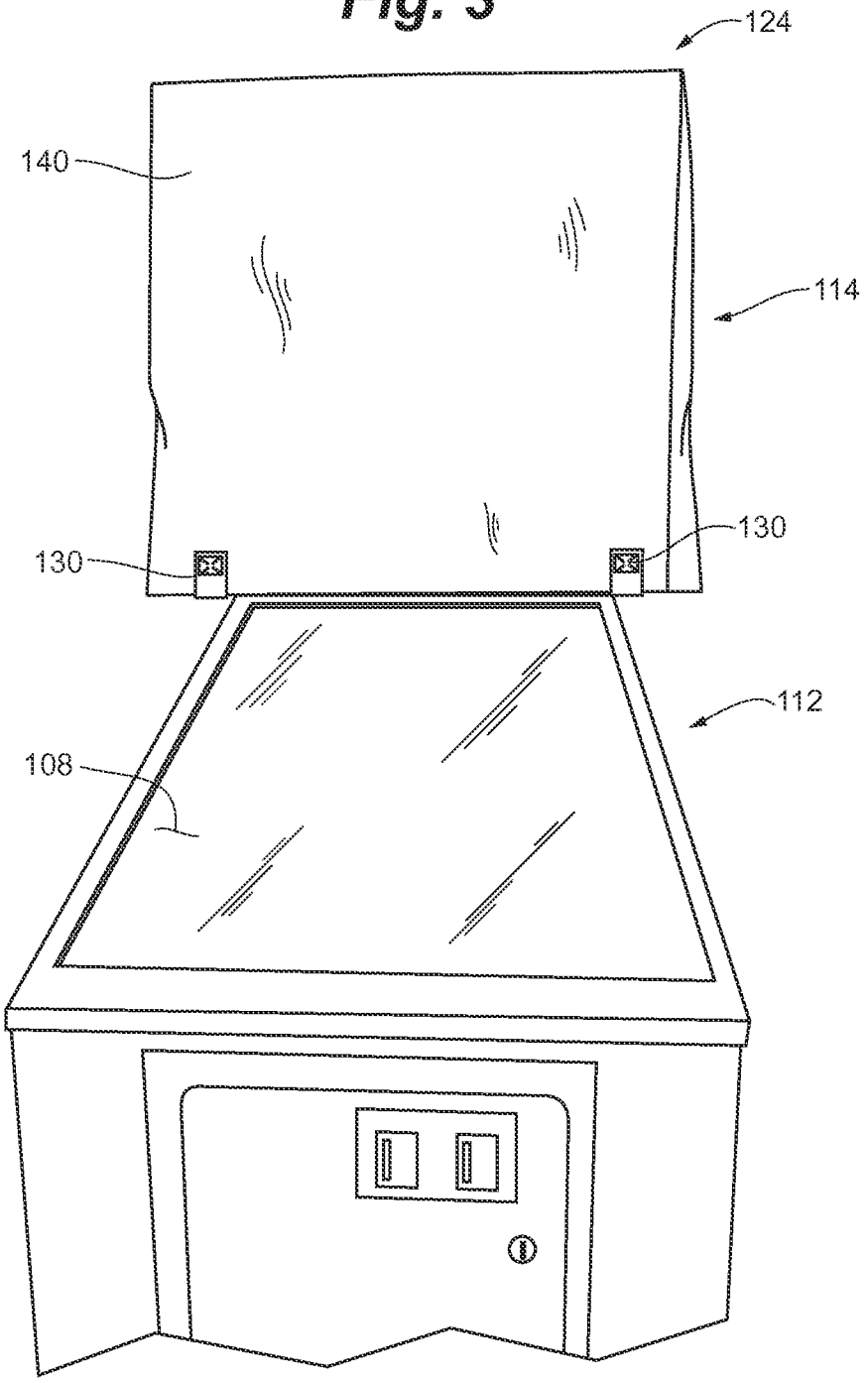
FIG. 3 is a front perspective view of a shell covering an upper cabinet of a pinball machine.
Figure 4:
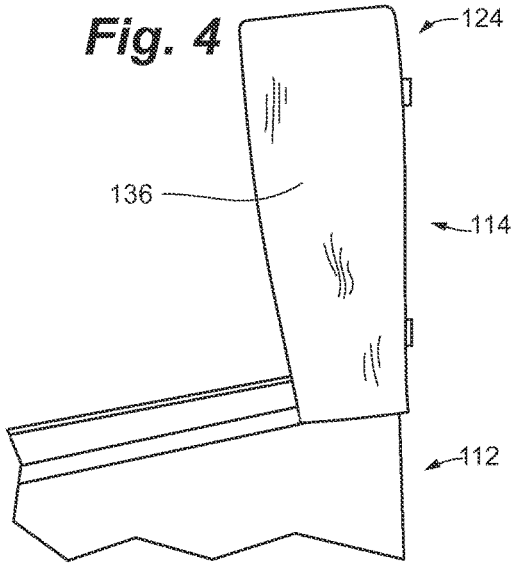
FIG. 4 is a side elevation view of a shell covering an upper cabinet of a pinball machine.
Figure 5:
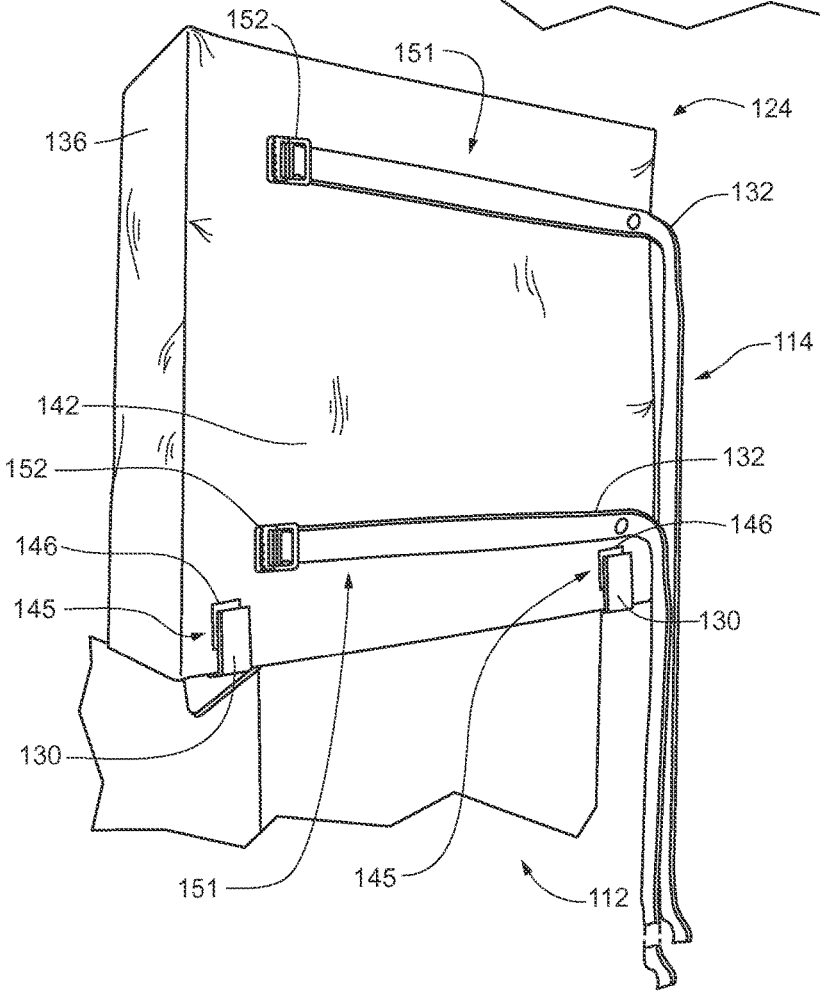
FIG. 5 is a rear perspective view of a shell covering an upper cabinet of a pinball machine.

FIGS. 3-5 respectively illustrate front, side, and rear perspective views of shell 124 placed over upper cabinet 114 of a pinball machine. In this example, the size of the shell 124 corresponds with the dimensions of the upper cabinet 114 such that substantially all of the upper cabinet 114 is enclosed and covered by the shell 124. FIG. 5 illustrates shell fastening apparatus 145 comprising a set of fastening mechanisms 146. In this example, the set of fastening mechanisms 146 include hook-and-loop fasteners where one side of the hook-and-loop fastener is attached to the set of straps 130 and the corresponding side of the hook-and-loop fastener is attached to the rear panel 142. Thus when the shell 124 receives the upper cabinet 114, the set of straps 130 can be secured to the rear panel 142 using the set of fastening mechanisms 146 thereby securing the upper cabinet 114 within shell 124. One skilled in the art will appreciate that in other examples, shell fastening apparatus 145 may comprise any type of fastening mechanisms suitable for a particular application. For example, shell fastening apparatus 145 may comprise buttons, snaps, buckle fasteners, plastic cling wrap, or combinations thereof.

In some examples, shell 124 may not include a shell fastening apparatus. Substantially all of the upper cabinet 114 may be enclosed and covered by the shell 124. But rather than fastening shell 124 closed around the upper cabinet 114, the upper cabinet 114 may be folded down into proximity with the lower cabinet 112.

Figure 6:
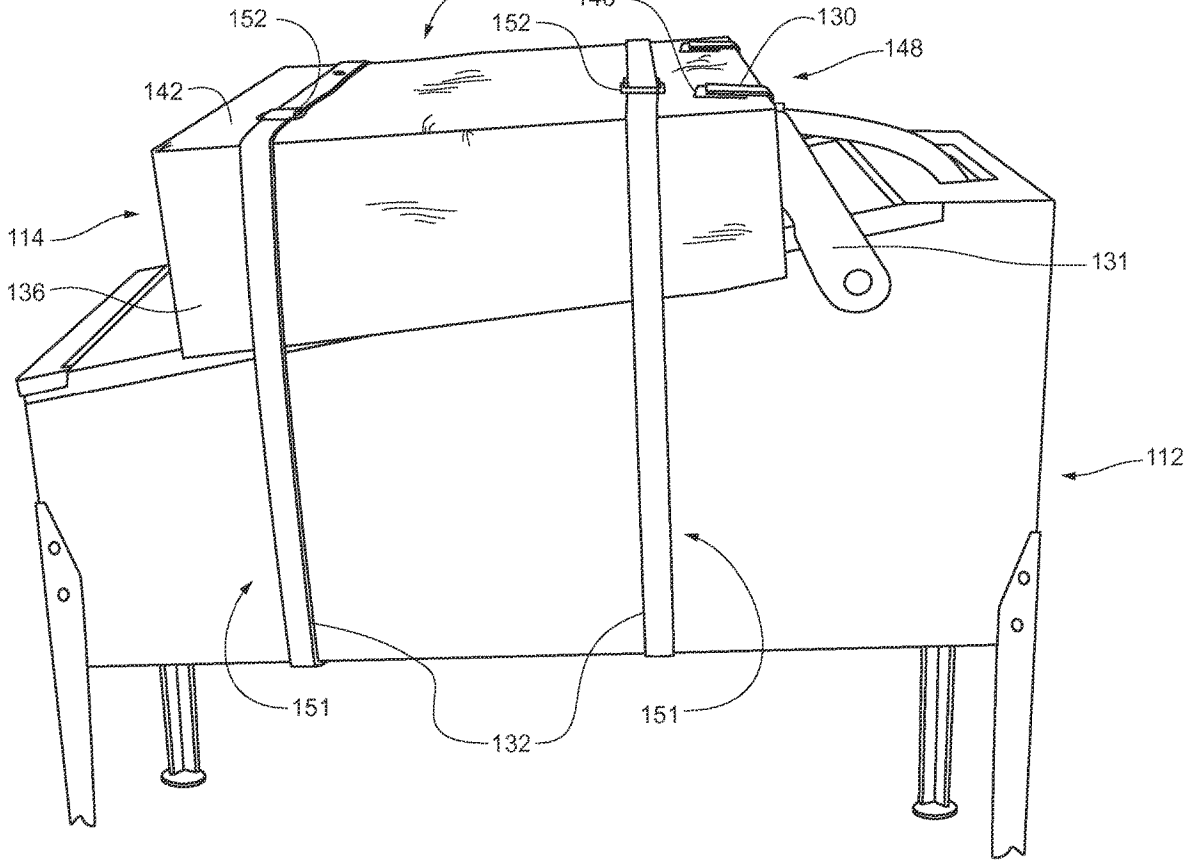
FIG. 6 is a side perspective view of a cabinet fastening apparatus securing a pinball machine in a folded-down configuration.

Referring to FIG. 6, in some examples, a pinball machine may include one or more braces 131 to support the upper cabinet 114 on a lower cabinet 112. The braces 131 may be attached to the outside surfaces of the lower cabinet 112 and the upper cabinet 114. In examples where the upper cabinet 114 is wider than the lower cabinet 112, the set of straps 130, when fastened, may be configured to engage with an underside of the upper cabinet 114 to secure the shell 124 to the upper cabinet 114. In other examples, the upper cabinet 114 may be rotated forward to allow the set of straps 130 to pass between or around the one or more braces 131, as necessary, to secure the upper cabinet 114 within shell 124.

Some examples may include a cabinet fastening apparatus that may be used together with collapsible pinball machines. In such examples, the pinball machine may be configured to allow an upper cabinet to fold down into proximity with the lower cabinet. In such examples, a cabinet fastening apparatus may be used to secure the upper cabinet (e.g., with a shell that is fastened, with a shell that is unfastened, without a shell, etc.) to the lower cabinet to minimize and/or eliminate damage to the pinball machine caused by relative movement between the two cabinets that may be caused, for example, by rough handling or vibrations during transportation or moving. In some examples, the cabinet fastening apparatus may be attached to, or integral with, a shell and may comprise one or more fastening mechanisms and one or more straps. In some examples, the cabinet fastening apparatus may be distinct or separate from the shell.

FIG. 5 illustrates a cabinet fastening apparatus 151 attached to rear panel 142. In this example, the cabinet fastening apparatus 151 is attached to shell 124 and includes a set of straps 132 and a set of fastening mechanisms 152. As shown, the set of straps 132 and the set of fastening mechanisms 152 have two straps and two fastening mechanisms, but it should be appreciated that the set of straps 132 and the set of fastening mechanisms 152 can include any suitable number of straps and fastening mechanisms, such as one, three, four, and so on. FIG. 6 illustrates the cabinet fastening apparatus 151 securing upper cabinet 114 to lower cabinet 112 when the pinball machine is in a folded-down configuration. The set of straps 132 may be of sufficient length to wrap around both upper cabinet 114 and lower cabinet 112, and the set of fastening mechanisms 152 may be configured to fasten the set of straps 132 to secure the cabinets together. In this example, fastening mechanisms 152 comprise buckle fasteners, but it can be appreciated that fastening mechanisms 152 may comprise any type of fastener suitable to secure the cabinets together including, but not limited to, buttons, snaps, clips, and hook-and-loop fasteners. In some examples, the cabinet fastening apparatus 151 may comprise plastic cling wrap. Thus, the cabinet fastening apparatus 151 may be used to limit or even eliminate relative movement between the upper cabinet 114 and the lower cabinet 112 by the application of appropriate tension to the set of straps 132. Once secured, the front panel 140 of the shell body 126 may provide a layer of protection between the upper cabinet 114 and the lower cabinet 112. This layer of protection can be particularly effective when the shell 124 is made of padded material. In some examples, additional protection may be provided by including padding attached to, or within, the front panel 140.

Strap dimensions, compositions, configurations, etc. can vary in different embodiments. In some embodiments, both the set of straps 130 as well as the set of straps 132 can be 1.5-inch wide nylon webbing. In some embodiments, the set of straps 130 can be approximately 12 inches long and the set of straps 132 can be approximately 120 inches long. Other strap widths and strap materials are also possible and contemplated. In addition, straps can be provided with additional buckles to adjust the overall strap lengths and/or different strap lengths can be provided in order to accommodate pinball machines of various dimensions. In some embodiments the straps can have elasticized elements incorporated into the strap material, giving the straps the ability to be secured around a wider range of both upper and lower cabinet sizes in order to accommodate pinball machines from different manufacturers and/or eras that may vary in dimensions.

In some examples, the cabinet fastening apparatus 151 may include padded straps. In some examples, the cabinet fastening apparatus 151 may include one or more padded sleeves configured to be fitted over the free ends of the set of straps 132. Padded straps and padded sleeves can provide additional protection to the surface finish of a lower cabinet. The position of padding and/or the position of padded sleeves relative to the set of straps 132 may coincide with portions of the cabinet that may be particularly susceptible or prone to damage during transportation or storage, for example the lower edges of a cabinet. In some examples, the amount of padding, or the padding material, may vary along a length of the set of straps 132 to coincide with portions of the cabinet more susceptible to damage. In some examples, padded straps and/or sleeves may be made from, for example, moving blanket material, neoprene, canvas, fleece, a closed cell foam, or any combination of one or more of these, or other materials.

In some examples, a cabinet fastening apparatus may not be included. The upper cabinet 114 (e.g., with a shell that is fastened, with a shell that is unfastened, without a shell, etc.) may be folded down into proximity with the lower cabinet 112, and the upper cabinet 114 may rest on the lower cabinet 112 without the upper cabinet 114 and lower cabinet 112 being fastened together.

Figure 7:
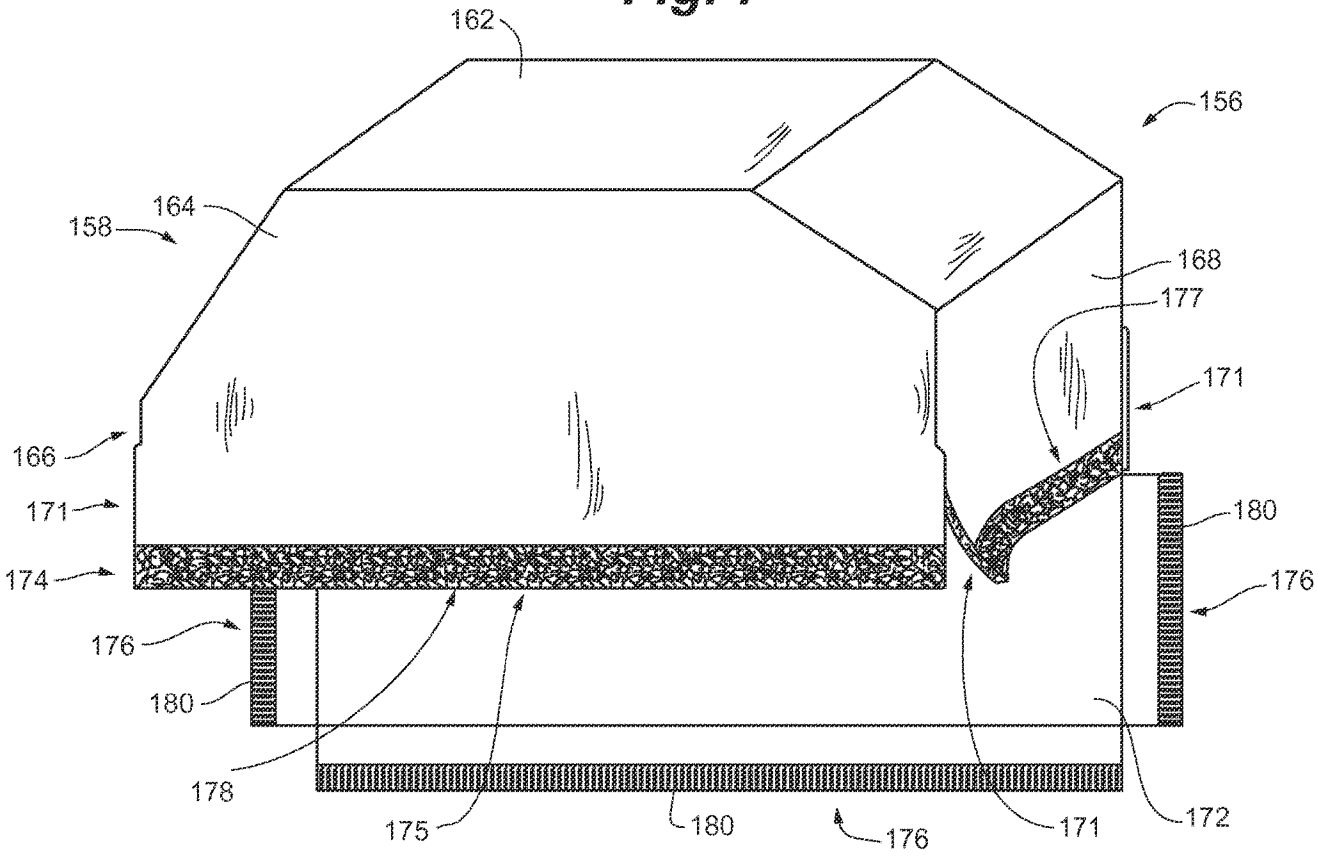
FIG. 7 is a front perspective view of a shell.

FIG. 7 illustrates a shell 156 according to some embodiments. In some examples, the shell 156 may comprise a shell body 158, an enclosing panel 172, and a shell fastening apparatus 177. In this example, the shell body 158 may include a top panel 162, two side panels 164, a front panel 166, and a rear panel 168. The shell body 158 may be configured to substantially enclose and cover a pinball machine. In some examples, the size of the shell body 158 may correspond with dimensions of a lower cabinet, a lower cabinet and an upper cabinet, or a collapsed pinball machine where an upper cabinet has been folded onto a lower cabinet. The shell body 158 may be configured to cover and enclose an upper cabinet shell that is covering the upper cabinet. In some examples, the shell body 158 may comprise a shell opening 175. In some examples, the shell opening 175 may be configured to receive a lower cabinet, a lower cabinet and an upper cabinet, or a collapsed pinball machine.

The enclosing panel 172 may be configured to substantially cover the shell opening 175. In some examples, the enclosing panel 172 may be attached to, or integral with, shell body 158. In other examples, the enclosing panel may be distinct, or separated from, shell body 158. In this example, the enclosing panel 172 is attached to one of the side panels (the one opposite side panel 164). In other examples, the enclosing panel 172 may be attached to either the front panel 166 or the rear panel 168; however, attaching the enclosing panel 172 to one of the side panels may provide for a more secure attachment to the shell body 158 and easier manipulation of the enclosing panel 172. FIG. 7 illustrates the enclosing panel 172 attached to a side panel (the one opposite side panel 164) and hanging down such that an inside surface 173 of the enclosing panel 172 is in view. In some examples, the size of enclosing panel 172 may correspond with the size of shell opening 175 such that the enclosing panel 172 completely, or substantially, covers the shell opening 175.

The shell fastening apparatus 177 may be configured to secure the enclosing panel 172 over the shell opening 175. In some examples, the shell 156 may include a skirt 174 disposed along at least one edge of the shell opening 175, and the shell fastening apparatus 177 may include one or more flaps 176. The shell fastening apparatus may be configured to secure flaps 176 of the enclosing panel 172 to the skirt 174. In some examples, the shell fastening apparatus 177 may include fastening mechanism 178 disposed along an edge of the skirt 174 and fastening mechanism 180 disposed along the edge of the enclosing panel 172. Thus, shell fastening apparatus 177 may secure the enclosing panel 172 over the shell opening by mating the fastening mechanism 178 with its corresponding fastening mechanism 180. In this example, fastening mechanism 178 may comprise one or more strips of loop fastener and fastening mechanism 180 may comprise one or more strips of hook fastener. The strips of the hook-and-loop fasteners may vary in width to provide for various advantages. For example, wider strips of hook-and-loop fasteners may allow the shell 156 to accommodate pinball machines of varying sizes as the greater width provides for greater overlap between fastening mechanisms 178 and 180. In one example, fastening mechanisms 178 and 180 may be 4 inches wide. In some examples, fastening mechanisms 178 and 180 may be between one inch and eight inches.

In some examples the skirt 174 and the one or more flaps 176 can have two or more rows of hook-and-loop fasteners in order to accommodate a greater range of pinball machine cabinet sizes. In some examples the skirt 174 and the one or more flaps 176 can have a plurality of rows of hook-and-loop fasteners, e.g., where each row can be narrower than 4 inches. For example, six rows of 1-inch wide hook-and-loop fasteners can be used on both the skirt 174 and the one or more flaps 176. Using a plurality of rows of hook-and-loop fasteners can provide more flexibility in accommodating a greater range of pinball machine cabinet sizes. In some examples the shell fastening apparatus 177 may comprise straps that can be used to secure the enclosing panel 172 in place against the bottom face of the lower cabinet. The use of straps to secure the enclosing panel 172 in place can further permit shell 156 to be used together with a greater range of pinball machine cabinet sizes. One skilled in the art will appreciate that shell fastening apparatus 177 may comprise any type of fastener including, but not limited to, zippers, buttons, snaps, clips, straps and buckles, plastic cling wrap, or any combination thereof.

In some examples, shell 156 may also include one or more slits 171 configured to provide access to the lower cabinet of a pinball machine while covered by shell 156. In some examples, a slit 171 may be fastened together by one or more fastening mechanisms including, but not limited to, hook-and-loop fasteners, zippers, buttons, snaps, clips, plastic cling wrap, straps and buckles, or any combination thereof. In some examples the one or more slits 171 may be positioned on shell body 158 such that unfastening the slits provides access to hardware retaining one or more legs of the pinball machine. In such examples, the one or more slits 171 may be configured to cover the hardware when fastened and provide access to the leg hardware when unfastened.

Figure 8:
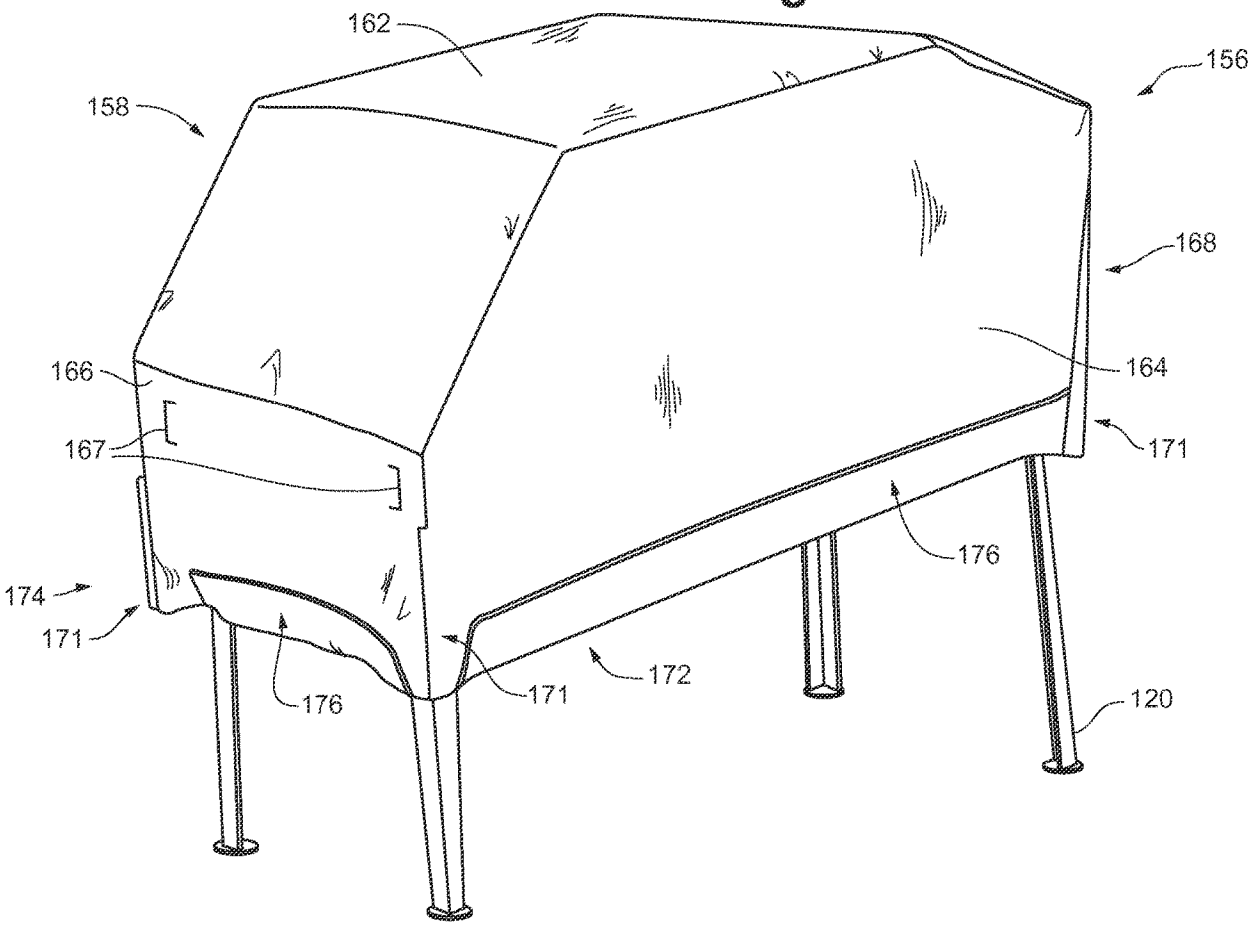
FIG. 8 is a front perspective view of a shell covering a pinball machine.

FIG. 8 illustrates shell 156 covering a collapsed pinball machine. In this example, shell 156 is secures a collapsed pinball machine where its upper cabinet is folded down onto the lower cabinet 112. As shown in FIG. 8, flaps 176 of the enclosing panel 172 are attached to the skirt 174 of the shell body 158 such that the enclosing panel 172 covers a bottom surface of lower cabinet 112. Once the shell 156 is fastened into place by its shell fastening apparatus 177, the cabinetry surfaces of the pinball machine are covered and protected thereby allowing the pinball machine to be more safely moved and/or stored.

In some examples, shell 156 may comprise a shell body 158 and a shell fastening apparatus 177. In some such examples, the shell body 158 may substantially cover a top surface, side surfaces, and a front surface of the lower cabinet 112 when secured by the shell fastening apparatus 177. In some such examples, the bottom surface and/or the rear surface of the lower cabinet 112 may be left uncovered. Many pinball machines do not have graphics or art displayed on the bottom or rear surfaces of the lower cabinet 112, so it may be unnecessary to cover those surfaces. In some examples, the shell body 158 may substantially cover the bottom surface and/or the rear surface of the lower cabinet 112 when secured by the shell fastening apparatus 177.

In some examples, enclosing panel 172 may comprise one or more openings configured to receive one or more legs 120 of a pinball machine. For example, FIG. 8 illustrates legs 120 of the pinball machine passing through openings of enclosing panel 172. In some examples, the openings may be appropriately positioned on the enclosing panel 172 to correspond with the position of the legs 120 of the pinball machine. The openings may be of varying shapes and sizes to accommodate legs 120 of varying sizes. In some examples, the openings may be substantially covered by an elastic material configured to form around a leg 120 that is received within the opening. Such elastic material may provide for a better fit as well as increased protection of the pinball machine from the elements. The openings can allow for increased convenience by allowing the pinball machine to be covered and stored with shell 156 without removing the legs 120. With the legs 120 attached, the bottom surface of the pinball machine can be elevated off the ground which makes it easier to fasten enclosing panel 172 to the shell body 158.

In some examples, legs 120 of a pinball machine may be removed, for example, to reduce the overall volume of the pinball machine for ease of transit or storage. Removing the legs 120 may lower the center of gravity of a pinball machine thereby increasing stability during transit. In certain examples, one or more slits 171 may be used to facilitate removal of the legs 120 of the pinball machine while the pinball machine is covered by shell 156. In such examples, slits 171 may initially be fastened to substantially cover a lower cabinet of the pinball machine. The slits 171 may then be unfastened to provide access to hardware retaining the legs 120 to the pinball machine. Once the hardware is exposed, a user may remove the legs 120 while the pinball machine is still covered by shell 156. In certain situations, the pinball machine may be manipulated onto its side so that each of the legs 120 may be removed. Similarly, in some examples slits 171 may be used to facilitate attaching of legs 120 of the pinball machine while the pinball machine is covered by shell 156. This feature can provide flexibility to a user to either remove or attach legs 120 as necessary during the course of transportation or storage without having to remove the pinball machine from shell 156.

Shell 156 may be configured to store the one or more legs 120 of the pinball machine. In some examples, the shell 156 may comprise one or more pockets 167 configured to receive and store one or more legs 120. For example, shell 156 may include one pocket 167 large enough to store four legs 120. In another example, shell 156 may include four pockets 167 each configured to store one leg 120 to minimize damage the legs 120 may occur during transit or incidental to storage. In some examples, the pockets 167 may be accessible from an exterior surface of shell 156 to allow the pinball machine to be completely covered before removing and storing the legs 120. In some examples, shell 156 may include one or more pockets 167 to store the hardware necessary to attach the legs 120 to the pinball machine. Each of the pockets 167 may be configured with fastening mechanisms to prevent the legs 120, or hardware, from falling out of its respective pockets 167. In certain examples, each pocket 167 may include a flap configured to cover an opening of each respective pocket 167. In such examples, fastening mechanisms may be used to fasten the flap closed over the opening of the pocket 167.

Figure 9:
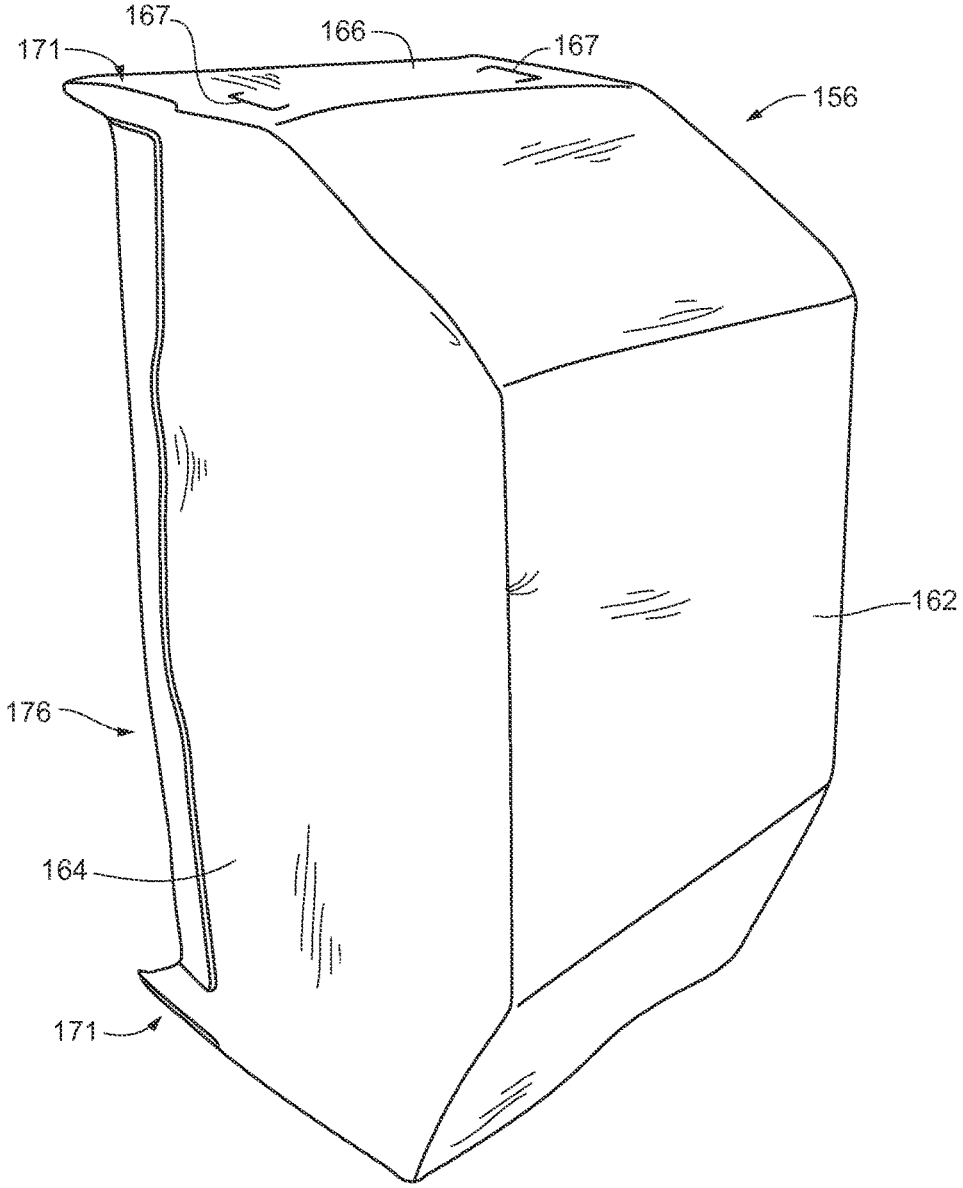
FIG. 9 is a perspective view of a shell covering a pinball machine.

FIG. 9 illustrates a covered pinball machine with its legs removed. In this example, the pinball machine is manipulated on its side which may facilitate the removal of legs of the pinball machine. Slits 171 may be fastened to substantially enclose the pinball machine and legs of the pinball machine may be stored in pockets 167.

In some examples, a shell covering the upper cabinet 114, shell 124, and the lower cabinet 112 may not be included. The upper cabinet 114 and shell 124 (fastened or unfastened) may be folded down into proximity with the lower cabinet 112, and the upper cabinet 114 and shell 124 may be fastened to the lower cabinet 112. The upper cabinet 114, shell 124, and the lower cabinet 112 may be left uncovered. In some such examples, the upper cabinet 114 can be wider than the lower cabinet 112, meaning that the covered upper cabinets 114 of pinball machines placed side by side will contact each other and that the uncovered lower cabinets will not contact each other.

Figure 10:
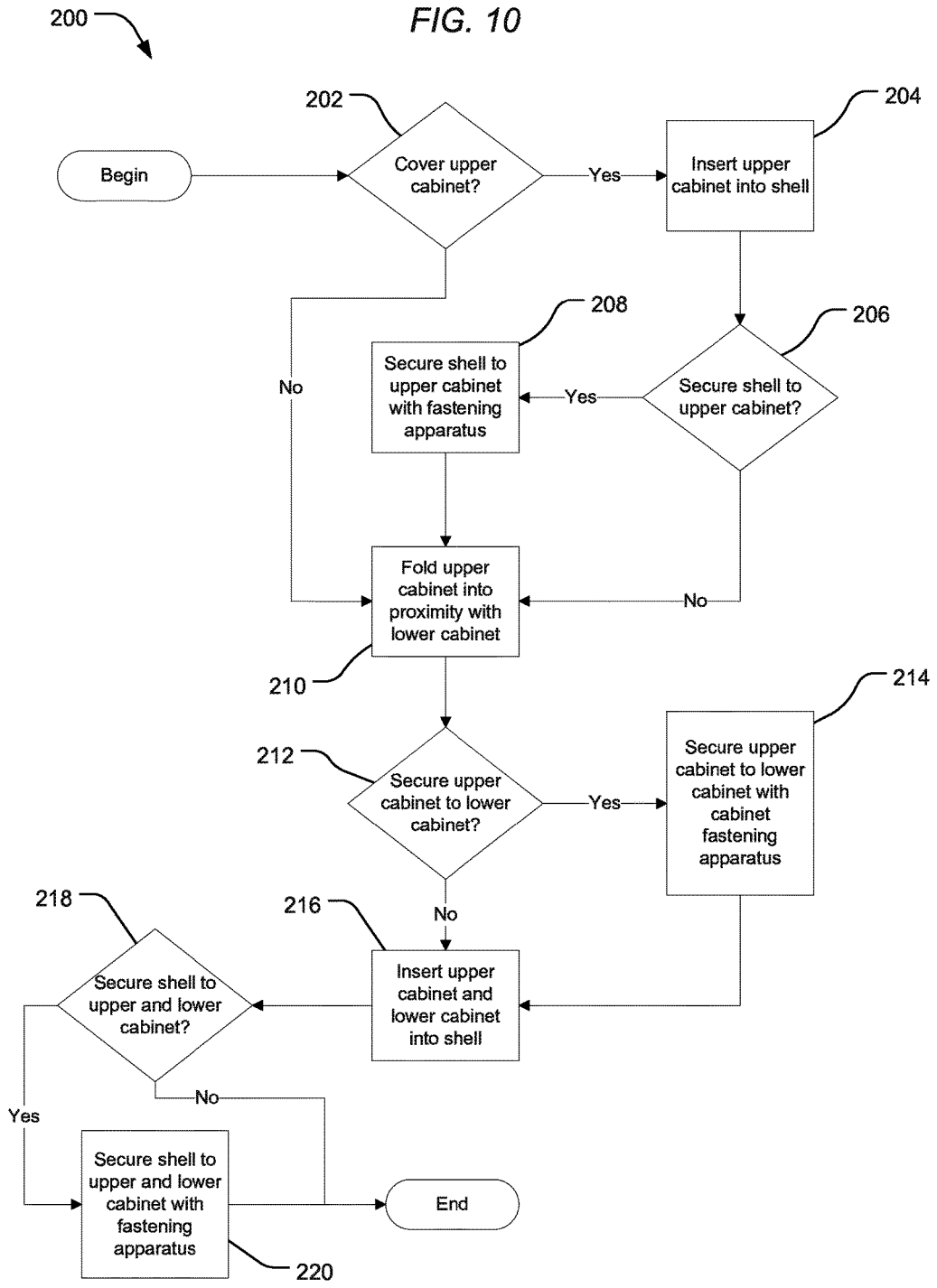
FIG. 10 is a flow chart illustrating a method in accordance with some embodiments of the present invention.

FIG. 10 is a flow chart illustrating a method 200 in accordance with some embodiments of the present invention for covering a pinball machine. Covering the pinball machine according to method 200 may include covering an upper cabinet of the pinball machine. In some examples, a user may decide not to cover the upper cabinet of the pinball machine in step 202 and proceed directly to step 210. In other examples, a user may decide in step 202 to cover the upper cabinet. If the user decides in step 202 to cover the upper cabinet, a shell may be provided that includes a shell body having a shell opening. The shell may be any of the shells discussed herein or any other suitable shell. The upper cabinet may be inserted into the shell body via the shell opening in step 204. In some examples, the user may decide in step 206 to secure the shell to the upper cabinet using a shell fastening apparatus in step 208. The shell fastening apparatus may be any of the shell fastening apparatuses discussed herein or any other suitable fastener. In other examples, the user may decide in step 206 not to secure the shell to the upper cabinet and proceed directly to step 210.

Step 210 of method 200 may include folding the upper cabinet of the pinball machine down into proximity with the lower cabinet. In some examples, the user may decide in step 212 not to secure the upper cabinet (covered or uncovered) to the lower cabinet of the pinball machine and proceed directly to step 216. If the user decides in step 212 to secure the upper cabinet to the lower cabinet, the upper cabinet may be secured to the lower cabinet using a cabinet fastening apparatus in step 214. The cabinet fastening apparatus may be any of the cabinet fastening apparatuses discussed herein or any other suitable fastener. Once the upper cabinet is secured to the lower cabinet, a shell may be provided that includes a shell body having a shell opening, and the upper cabinet (covered or uncovered) and the lower cabinet may be inserted into the shell opening in step 216. In some examples, the user may decide in step 218 to secure the shell to the upper and lower cabinet with a fastening apparatus in step 220. The shell fastening apparatus may be any of the shell fastening apparatuses discussed herein or any other suitable fastener. In other examples, the user may decide in step 218 not to secure the shell to the upper and lower cabinet.

In some examples, areas of the pinball machine may be selectively covered based on a location or position of graphics or other features that provide value to the pinball machine. In one example, covering the upper cabinet and the lower cabinet may include substantially covering a top surface, side surfaces, and a front surface of the lower cabinet where graphics of the pinball machine may be located. In other examples, the pinball machine may be covered more comprehensively without regard for the location or position of graphics or other value-adding features of the pinball machine. For example, covering the pinball machine may include covering a bottom surface and a rear surface of the lower cabinet where graphics of the pinball machine are not likely located.

Figure 11:
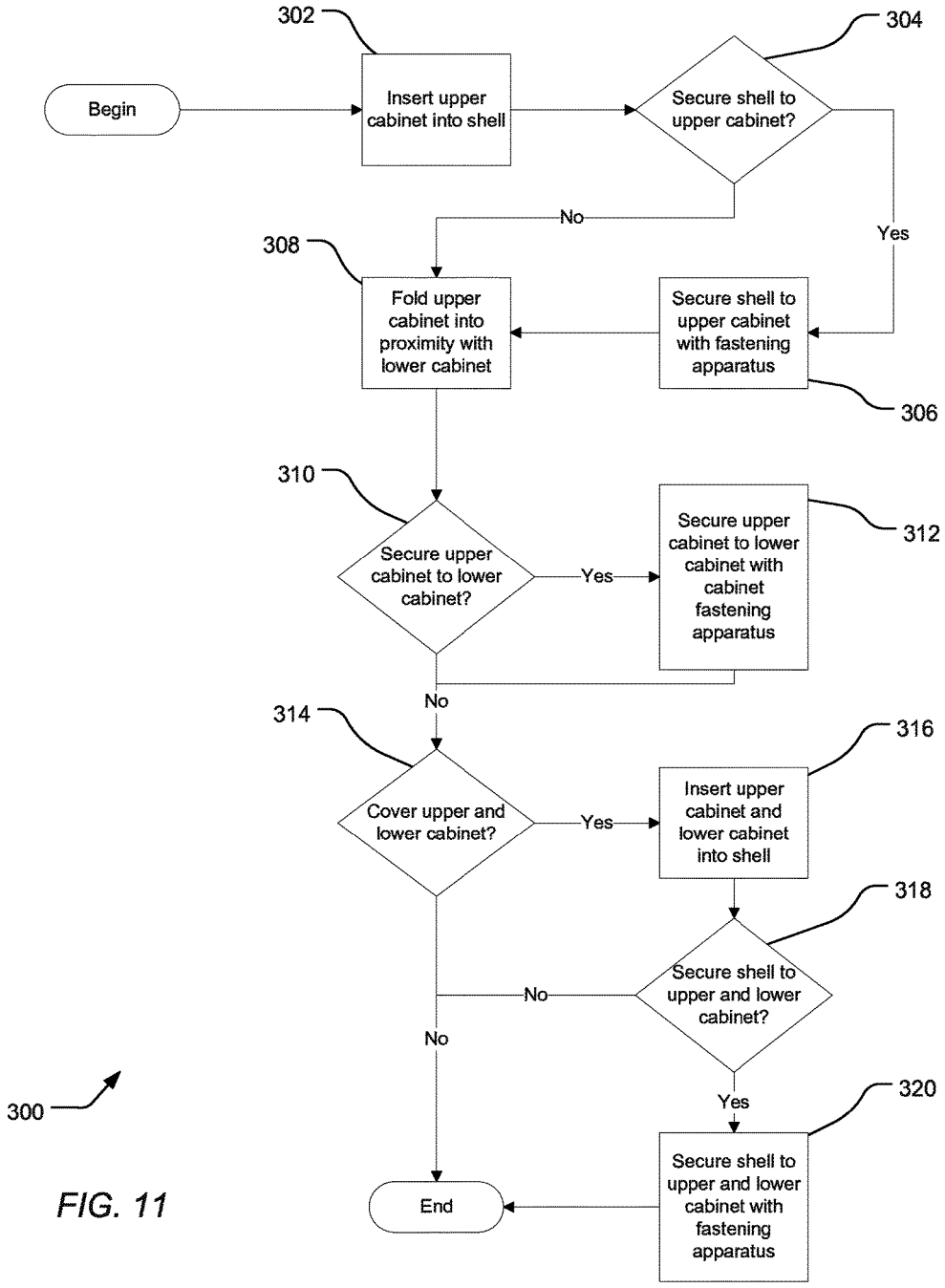
FIG. 11 is a flow chart illustrating a method in accordance with some embodiments of the present invention.

FIG. 11 is a flow chart illustrating a method 300 in accordance with some embodiments of the present invention for covering a pinball machine. Covering the pinball machine may include covering an upper cabinet of the pinball machine. In some examples, a shell may be provided that includes a shell body and a shell opening, and covering the upper cabinet may comprise inserting the upper cabinet into the shell body via the shell opening in step 302. The shell may be any of the shells discussed herein or any other suitable shell. In some examples, the user may decide in step 304 to secure the shell to the upper cabinet using a shell fastening apparatus in step 306. The shell fastening apparatus may be any of the shell fastening apparatuses discussed herein or any other suitable fastener. In other examples, the user may decide in step 304 not to secure the shell to the upper cabinet and proceed directly to step 308.

Step 308 of method 300 may include folding the upper cabinet of the pinball machine down into proximity with a lower cabinet. In some examples, the user may decide in step 310 not to secure the upper cabinet to the lower cabinet of the pinball machine and proceed directly to step 314. If the user decides in step 310 to secure the upper cabinet to the lower cabinet, the upper cabinet may be secured to the lower cabinet using a cabinet fastening apparatus in step 312. The cabinet fastening apparatus may be any of the cabinet fastening apparatuses discussed herein or any other suitable fastener. Once the upper cabinet is secured to the lower cabinet, the user may decide in step 314 to cover the upper cabinet and the lower cabinet. If the user decides not to cover the upper cabinet and the lower cabinet in step 314, the covered upper cabinet may rest on the lower cabinet in a folded-down configuration (fastened together or not fastened together). If the user decides to cover the upper cabinet and the lower cabinet in step 314, a shell may be provided that includes a shell body and a shell opening, and covering the upper cabinet and the lower cabinet may comprise inserting the upper cabinet and the lower cabinet into the shell body via the shell opening in step 316. The shell may be any of the shells discussed herein or any other suitable shell. In some examples, the user may decide in step 318 to secure the shell to the upper and lower cabinet with a fastening apparatus in step 320. The shell fastening apparatus may be any of the shell fastening apparatuses discussed herein or any other suitable fastener.

Some advantages of the subject matter described herein include a covering that is simple and straightforward to place and secure on a pinball machine. Some illustrative covers can be configured such that a single user may cover the pinball machine without need for assistance. Some illustrative pinball machine covers described herein can be securely positioned in place with minimal effort and can resist movement during transportation, thereby providing an enhanced level of protection to the cabinet of a pinball machine.

In some examples, a cover may include padding or be formed from materials to better protect a pinball machine. The padding or material used may vary based on what surface of the pinball machine is being protected. For example, a shell may include impact-absorbing/cushioning padding as the shell may come into contact with a glass surface of an upper cabinet as well as a glass sheet of the lower cabinet. In some examples, a shell may be formed from a material that is thick and/or abrasive resistant to protect the pinball machine from environmental hazards. The padding or material used may vary based on a specific application of the cover. For example, a cover to be used for storage only may be formed from insulated material to protect the pinball machine from humidity and/or temperature changes that may damage the pinball machine over time. In another example, a cover to be used for moving may include durable plates attached to an outside of, or embedded within, a cover to allow the cover to be slid along an edge or to prevent damage from moving tools (e.g., a dolly). In some examples, the durable plates may comprise plastic, one or more metals, foam, or any combination thereof. Materials that may be used to form the cover include, but is not limited to, neoprene, canvas, moving-blanket type material, nylon, fleece, and/or foam. In certain examples, the outside of the cover may be marked to aid a user to orient a top and bottom of the covered pinball machine.

Additional benefits and advantages of some of the embodiments discussed herein can include protecting a pinball machine from fading due to light exposure, which can include exposure to direct sunlight and/or other light sources. Some protection can be provided from extreme temperature fluctuations that can be encountered, for example, when a pinball machine is moved from a climate controlled environment to the outdoors and then into a transportation vehicle. Such temperature fluctuations may be especially pronounced during extreme weather, which can include moves during colder weather in northern climates, and/or during warmer weather in southern climates. Some protection can be provided from precipitation, such as a snowfall or exposure to rain, for example, as well as from damage that can be caused by rodent or insect infestations.

In the foregoing detailed description, the invention has been described with reference to specific embodiments. However, it may be appreciated that various modifications and changes can be made without departing from the scope of the invention.

What is claimed is:

1. A cover apparatus for use with a pinball machine that has an upper cabinet hingedly connected to a lower cabinet, the cover apparatus comprising:

a first shell configured to cover and enclose the upper cabinet of the pinball machine, the first shell including a first-shell body including a first-shell body top panel, two first-shell body side panels, a first-shell body front panel, and a first-shell body rear panel sized to correspond with dimensions of the upper cabinet of the pinball machine and to enclose front, back, top, right and left sides of the upper cabinet of the pinball machine and having a first-shell opening configured to receive the upper cabinet;

a second shell configured to cover and enclose the upper cabinet of the pinball machine and the first shell in a folded-down configuration, as well as the lower cabinet of the pinball machine, the second shell including:

a second-shell body sized to correspond with dimensions of the upper cabinet of the pinball machine in the folded-down configuration in conjunction with the lower cabinet of the pinball machine, the second-shell body having a second-shell opening configured to receive the upper cabinet, the first shell, and the lower cabinet, and a second-shell fastening apparatus configured to secure the second shell relative to the received upper cabinet, the first shell, and the lower cabinet; and a cabinet fastening apparatus configured to secure the upper cabinet and the first shell in the folded-down configuration to the lower cabinet.

2. The apparatus of claim 1, wherein the first shell further includes a first-shell fastening apparatus coupled to the first-shell body and configured to secure the upper cabinet within the first-shell body.

3. The apparatus of claim 2, wherein the first-shell fastening apparatus comprises one or more fastening mechanisms and one or more straps.

4. The apparatus of claim 3, wherein the one or more fastening mechanisms of the first-shell fastening apparatus are configured to secure the one or more straps of the first-shell fastening apparatus across the first-shell opening to secure the upper cabinet within the first-shell body.

5. The apparatus of claim 3, wherein the one or more fastening mechanisms are selected from a group consisting of buttons, snaps, clips, and hook-and-loop fasteners.

6. The apparatus of claim 1, wherein the cabinet fastening apparatus is coupled to the first shell.

7. The apparatus of claim 6, wherein the cabinet fastening apparatus is integral with the first shell.

8. The apparatus of claim 1, wherein the cabinet fastening apparatus comprises one or more fastening mechanisms and one or more straps.

9. The apparatus of claim 8, wherein the one or more straps of the cabinet fastening apparatus are configured to wrap around both the upper cabinet and the lower cabinet and the one or more fastening mechanisms of the cabinet fastening apparatus are configured to fasten the one or more straps to secure the upper cabinet to the lower cabinet.

10. The apparatus of claim 1, wherein the second shell is configured to substantially cover a top surface, side surfaces, and a front surface of the lower cabinet when secured by the second-shell fastening apparatus.

11. The apparatus of claim 10, wherein the second shell is further configured to substantially cover a bottom surface and a rear surface of the lower cabinet when secured by the second-shell fastening apparatus.

12. The apparatus of claim 1, wherein the second shell further includes one or more slits configured to provide access to hardware retaining one or more legs of the pinball machine.

13. The apparatus of claim 1, wherein the second shell further includes one or more pockets configured to store one or more legs of the pinball machine.

14. The apparatus of claim 1, wherein the second-shell body includes a second-shell body top panel, two second-shell body side panels, a second-shell body front panel, and a second-shell body rear panel sized to correspond with dimensions of the upper cabinet of the pinball machine in the folded-down configuration in conjunction with the lower cabinet of the pinball machine.

15. A cover apparatus for use with a pinball machine that has an upper cabinet hingedly connected to a lower cabinet, the cover apparatus comprising:

a first shell configured to cover the upper cabinet of the pinball machine, the first shell including a first-shell body having a first-shell opening configured to receive the upper cabinet; and a second shell configured to cover the upper cabinet of the pinball machine and the first shell in a folded-down configuration, as well as the lower cabinet of the pinball machine, the second shell including:

a second-shell body having a second-shell opening configured to receive the upper cabinet, the first shell, and the lower cabinet, and a second-shell fastening apparatus configured to secure the second shell relative to the received upper cabinet, the first shell, and the lower cabinet, wherein the second shell is configured to substantially cover a top surface, side surfaces, and a front surface of the lower cabinet when secured by the second-shell fastening apparatus, wherein the second shell is further configured to substantially cover a bottom surface and a rear surface of the lower cabinet when secured by the second-shell fastening apparatus, wherein the second shell further includes a panel that is integral with the second-shell body and a skirt disposed along at least one edge of the second-shell opening, the second-shell fastening apparatus being configured to secure the panel to the skirt to cover the bottom surface of the lower cabinet.

16. A method for covering a pinball machine that has an upper cabinet hingedly connected to a lower cabinet, the method comprising:

covering the upper cabinet with a cover apparatus, the cover apparatus comprising:

a shell configured to cover and enclose the upper cabinet of the pinball machine, the shell including a shell body including a top panel, two side panels, a front panel, and a rear panel sized to correspond with dimensions of the upper cabinet of the pinball machine to cover and enclose front, back, top, right and left sides of the upper cabinet of the pinball machine and having a shell opening configured to receive the upper cabinet;

a shell fastening apparatus coupled to the shell body configured to secure the shell to the received upper cabinet with the front, back, top, right and left sides of the upper cabinet of the pinball machine covered by the shell, wherein the shell and the shell fastening apparatus are configured to facilitate folding the upper cabinet towards the lower cabinet with the shell secured to the upper cabinet by the shell fastening apparatus; and a cabinet fastening apparatus configured to secure the upper cabinet and the shell in a folded-down configuration to the lower cabinet, wherein covering the upper cabinet with the cover apparatus includes inserting the upper cabinet into the shell body via the shell opening;

folding the upper cabinet down into proximity with the lower cabinet; and securing the shell and the upper cabinet to the lower cabinet using the cabinet fastening apparatus.

17. The method of claim 16, wherein the shell further includes a shell fastening apparatus coupled to the shell body, and wherein the method further comprises securing the upper cabinet within the shell body with the shell fastening apparatus after covering the upper cabinet with the shell but before folding the upper cabinet down into proximity with the lower cabinet.

18. The method of claim 17, wherein the shell fastening apparatus comprises one or more fastening mechanisms and one or more straps, and securing the upper cabinet within the shell body comprises fastening the one or more straps of the shell fastening apparatus across the shell opening using the one or more fastening mechanisms.

19. The method of claim 16, wherein the cabinet fastening apparatus comprises one or more fastening mechanisms and one or more straps, and securing the upper cabinet to the lower cabinet comprises wrapping the one or more straps of the cabinet fastening apparatus around both the upper cabinet and the lower cabinet and fastening the one or more straps using the one or more fastening mechanisms of the cabinet fastening apparatus.

20. The method of claim 16, wherein the shell is a first shell, the method further comprising:

providing a second shell that includes:

a second-shell body having a second-shell opening, and a second-shell fastening apparatus; and covering the upper cabinet, the first shell, and the lower cabinet with the second shell by:

inserting the upper cabinet, the first shell, and the lower cabinet into the second-shell body via the second-shell opening, and securing the second shell relative to the upper cabinet, the first shell, and the lower cabinet.

21. The method of claim 20, wherein the second shell further includes a panel that is integral with the second-shell body and a skirt disposed along at least one edge of the second-shell opening, the method further comprising:

securing, with the second-shell fastening apparatus, the panel to the skirt to cover the bottom surface of the lower cabinet.

22. The method of claim 20, wherein the second-shell body includes a second-shell body top panel, two second-shell body side panels, a second-shell body front panel, and a second-shell body rear panel sized to correspond with dimensions of the upper cabinet of the pinball machine in the folded-down configuration in conjunction with the lower cabinet of the pinball machine.

23. A cover apparatus for use with a pinball machine that has an upper cabinet hingedly connected to a lower cabinet, the cover apparatus comprising:

a shell configured to cover and enclose the upper cabinet of the pinball machine, the shell including a shell body including a top panel, two side panels, a front panel, and a rear panel sized to correspond with dimensions of the upper cabinet of the pinball machine to cover and enclose front, back, top, right and left sides of the upper cabinet of the pinball machine and having a shell opening configured to receive the upper cabinet;

a shell fastening apparatus coupled to the shell body configured to secure the shell to the received upper cabinet with the front, back, top, right and left sides of the upper cabinet of the pinball machine covered by the shell, wherein the shell and the shell fastening apparatus are configured to facilitate folding the upper cabinet towards the lower cabinet with the shell secured to the upper cabinet by the shell fastening apparatus; and a cabinet fastening apparatus configured to secure the upper cabinet and the shell in a folded-down configuration to the lower cabinet.

24. The apparatus of claim 23, wherein the cabinet fastening apparatus includes a set of straps configured to wrap around both the folded upper cabinet with in the shell and the lower cabinet to maintain the upper cabinet in the folded position.

25. The apparatus of claim 24, further comprising one or more padded sleeves configured to be fitted over free ends of the set of straps to provide protection to a surface finish of the lower cabinet.

26. The apparatus of claim 23, wherein the cabinet fastening apparatus is coupled to the shell.

27. The apparatus of claim 23, wherein the cabinet fastening apparatus is integral with the shell.

28. The apparatus of claim 23, wherein the shell opening is sized to receive the top of the upper cabinet to allow the shell body to slide over the top, front, back, right and left sides of the upper cabinet of the pinball machine.

29. The apparatus of claim 28, wherein the shell fastening apparatus includes one or more fastening mechanisms, and wherein the one or more fastening mechanisms of the shell fastening apparatus are configured to secure the one or more straps of the shell fastening apparatus across the shell opening to secure the upper cabinet within the shell body.

30. The apparatus of claim 29, wherein the one or more fastening mechanisms are selected from a group consisting of buttons, snaps, clips, and hook-and-loop fasteners.

31. The apparatus of claim 23, wherein the shell body includes impact absorbing padding oriented to come in contact with a glass surface of the upper cabinet as well as a glass sheet of the lower cabinet with the upper cabinet and the shell secured to the lower cabinet in the folded-down configuration.

32. The apparatus of claim 23, wherein the cabinet fastening apparatus comprises one or more fastening mechanisms and one or more straps.

* * * * *